US011829840B2

(12) United States Patent
Luks

(10) Patent No.: US 11,829,840 B2
(45) Date of Patent: Nov. 28, 2023

(54) CLOTHES WEAR COUNTER FOR A HANGER

(71) Applicant: EGRET ASSOCIATES, INC., Jupiter, FL (US)

(72) Inventor: Dawn Luks, Jupiter, FL (US)

(73) Assignee: Egret Associates, Inc., Jupiter, FL (US)

( * ) Notice: Subject to any disclaimer, the term of this patent is extended or adjusted under 35 U.S.C. 154(b) by 119 days.

(21) Appl. No.: 17/650,153

(22) Filed: Feb. 7, 2022

(65) Prior Publication Data

US 2022/0253666 A1 Aug. 11, 2022

Related U.S. Application Data

(60) Provisional application No. 63/146,907, filed on Feb. 8, 2021.

(51) Int. Cl.
*G06M 1/08* (2006.01)
*A47G 25/14* (2006.01)

(52) U.S. Cl.
CPC ..... *G06M 1/083* (2013.01); *A47G 25/1428* (2013.01)

(58) Field of Classification Search
CPC ..... G06M 1/083; A47G 25/1428
USPC ..... 235/103
See application file for complete search history.

(56) References Cited

U.S. PATENT DOCUMENTS

| | | | | |
|---|---|---|---|---|
| 1,381,881 | A | 6/1921 | Lely | |
| 2,169,552 | A | 8/1939 | Bellin | |
| 3,124,284 | A | 3/1964 | Collum | |
| 4,886,010 | A | 12/1989 | Stutzman | |
| 5,499,466 | A | 3/1996 | House | |
| 5,564,361 | A | 10/1996 | Satterwhite | |
| D430,219 | S | 8/2000 | Chagan | |
| 6,330,969 | B1 | 12/2001 | Villaraut | |
| 7,246,730 | B2 | 7/2007 | Russo | |
| 3,069,595 | A1 | 12/2011 | Aiezza | |
| 8,534,513 | B1 * | 9/2013 | Dixon | A47G 25/485 223/91 |
| 8,627,584 | B2 | 1/2014 | Aiezza | |
| 9,380,902 | B2 | 7/2016 | Kirkwood | |
| 9,480,354 | B2 | 11/2016 | Eden | |
| 9,601,037 | B1 | 3/2017 | Ransom | |
| D845,807 | S | 4/2019 | Wong | |

(Continued)

FOREIGN PATENT DOCUMENTS

| | | |
|---|---|---|
| GB | 2372697 | 9/2002 |
| KR | 101054152 | 10/2010 |

(Continued)

*Primary Examiner* — Daniel A Hess
(74) *Attorney, Agent, or Firm* — McHale & Slavin, P.A.

(57) ABSTRACT

An article of clothing wear indicator and/or use counter for tracking the number of times an article of clothing has been worn. The clothing wear tracker includes an intermediate portion or body, an upper portion or body, and a lower portion or body. Preferably, the clothing wear tracker is configured to allow both the upper portion or body and the lower portion or body to rotate about the intermediate portion or body independently. The clothing wear tracker is designed to fit or secure to a hanger and to provide a mechanism for tracking the number of times a user wears an article of clothing, such as a shirt, a blouse, pants, or a dress, and is easily attachable or securable to a clothing hanger.

18 Claims, 16 Drawing Sheets

(56) References Cited

U.S. PATENT DOCUMENTS

| | | | | |
|---|---|---|---|---|
| 2016/0270576 | A1* | 9/2016 | Kirkwood | A47G 25/1428 |
| 2021/0358334 | A1* | 11/2021 | Torgersen | G06M 1/00 |

FOREIGN PATENT DOCUMENTS

| | | |
|---|---|---|
| KR | 20180057130 | 5/2018 |
| KR | 20190087921 | 7/2019 |

* cited by examiner

CLOTHES WEAR COUNTER FOR A HANGER

CROSS REFERENCE TO RELATED APPLICATIONS

In accordance with 37 C.F.R. 1.76, a claim of priority is included in an Application Data Sheet filed concurrently herewith. Accordingly, the present invention claims priority to U.S. Provisional Patent Application No. 63/146,907, entitled "CLOTHES WEAR COUNTER FOR A HANGER", filed Feb. 8, 2021. The contents of the above referenced application are incorporated herein by reference in their entirety.

FIELD OF THE INVENTION

The present invention relates to a device for use with articles of clothing; and more particularly to a hanger attachable device for tracking the number of wear times associated with a particular garment or article of clothing.

BACKGROUND OF THE INVENTION

The wearing of one or more types of clothing is an everyday occurrence for most people. Regardless of intended use, i.e. casual wear for running errands around town, business related for meeting clients or conducting business, or formal clothing for formal occasions, maintaining one's clothing is important in order to avoid public embarrassment associated with dirty, smelly clothing or just an unkempt appearance. While washing clothing after each use would remove such issues, not all articles of clothing need to be washed with such frequency. In fact, for some clothing materials, washing after each use may shorten the length of the article of clothing's life cycle.

In the situation where clothing was not cleaned or laundered after each use, to successfully avoid public embarrassment resulting from dirty or smelly clothing as a result of overuse, a user would have to develop a system for knowing how many times an article of clothing had been worn before it was time for a cleaning. While developing a written log might be one option, written logs can be cumbersome, particularly if one has a large number of items of clothing to track, and requires discipline to write the proper information down every time. In addition, every time a person wears an item of clothing, he/she would need to make an effort and take the time to look through the log to verify wear status.

Numerous devices configured to provide a user the ability to track clothing wear dates are known in the art. For example, U.S. Pat. No. 9,601,037, is described as disclosing a hanger date indicator device additional to a clothes hanger by threadable engagement of a hanger hook through a central aperture to position and maintain the hanger date indicator device above an item of clothing depended upon the hanger. U.S. Pat. No. 9,480,354, is described as disclosing a garment hanger with use indicators for tracking clothing wear. U.S. Pat. No. 9,380,902, is described as disclosing a hanger accessory device for keeping track of how many times an article of clothing has been worn since it was last laundered, which includes a housing unit for attaching to a hanger. By rotating the housing (and thus the outwardly-facing markings) around a stem of a hanger, an individual may keep track of how many times an article of clothing has been worn or used between washings. Other devices keeping track of how many times an article of clothing has been worn may include U.S. Pat. Nos. 8,627,584, 8,069,595, 7,246,730, 6,330,969, 5,564,361, 5,499,466, 4,886,010, 3,124,284, 2,169,552, 1,381,881, D845,807, D430,219, Korean (KR) Patent No. 101054152, Korean (KR) Publication No. 20180057130, Korean (KR) Publication No. 20190087921, and Great Britain (GB) Patent No. 2372697.

The present invention, which is configured to attach to a hanger, provides a unique device for tracking the number of times a user wears a garment or article of clothing.

SUMMARY OF THE INVENTION

The present invention relates to an article of clothing wear indicator and/or use counter for tracking the number of times an article of clothing has been worn. The clothing wear tracker includes an intermediate portion or body, an upper portion or body, and a lower portion or body. Preferably, the clothing wear tracker is configured to allow both the upper portion or body and the lower portion or body to rotate about the intermediate portion or body independently. The clothing wear tracker is designed to fit or secure to a hanger and to provide a mechanism for tracking the number of times a user wears an article of clothing, such as a shirt, a blouse, pants, or a dress, and is easily attachable or securable to a clothing hanger.

Accordingly, it is an objective of the invention to provide an article of clothing wear indicator and/or use counter for tracking the number of times an article of clothing has been worn.

It is an objective of the invention to provide an article of clothing wear indicator and/or use counter for tracking the number of times an article of clothing has been worn since washing or cleaning.

It is a further objective of the invention to provide an article of clothing wear indicator and/or use counter for tracking the number of times an article of clothing has been worn since washing or cleaning having an upper portion or counter ring, a lower portion or article ring, and an intermediate portion.

It is yet another objective of the invention to provide an article of clothing wear indicator and/or use counter for tracking the number of times an article of clothing has been worn since washing or cleaning having an upper portion or counter ring, a lower portion or article ring, and an intermediate portion, where the upper portion rotates relative to the intermediate portion.

It is a still further objective of the invention to provide an article of clothing wear indicator and/or use counter for tracking the number of times an article of clothing has been worn since washing or cleaning having an upper portion or counter ring, a lower portion or article ring, and an intermediate portion, where the lower portion rotates relative to the intermediate portion.

It is yet another objective of the invention to provide an article of clothing wear indicator and/or use counter for tracking the number of times an article of clothing has been worn since washing or cleaning having an upper portion or counter ring, a lower portion or article ring, and an intermediate portion, where the lower portion and the upper portion rotate independently.

Other objectives and advantages of this invention will become apparent from the following description taken in conjunction with any accompanying drawings wherein are set forth, by way of illustration and example, certain embodiments of this invention. Any drawings contained herein constitute a part of this specification, include exemplary embodiments of the present invention, and illustrate various objects and features thereof.

DETAILED DESCRIPTION OF THE INVENTION

Figure 1:
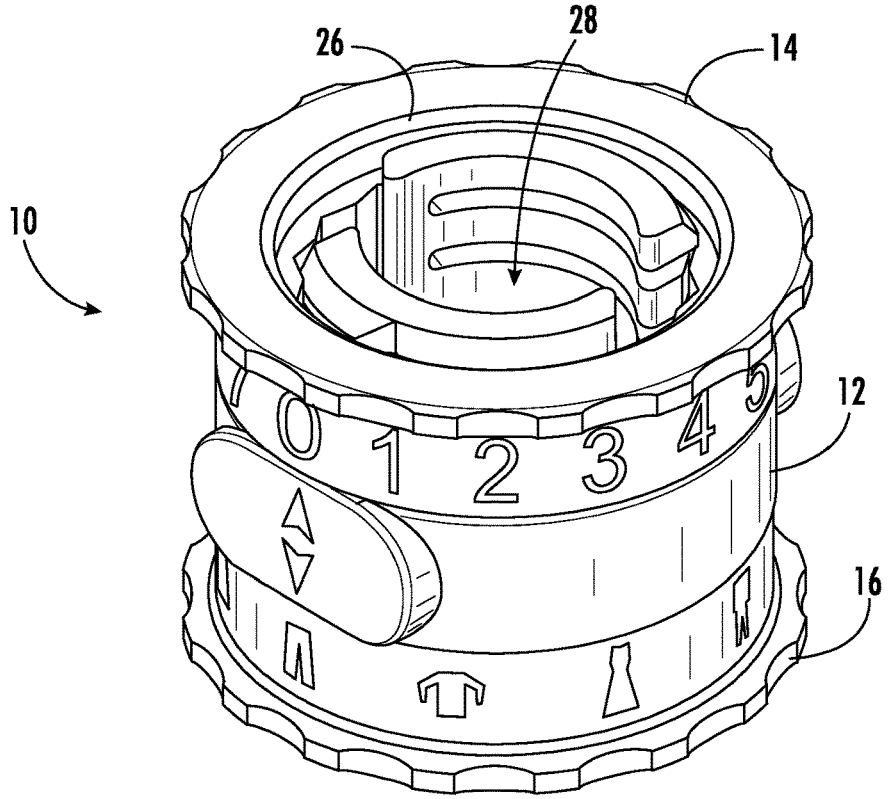
FIG. 1 is a perspective view of an illustrative embodiment of a hanger attachable article of clothing wear indicator and/or use counter.

While the present invention is susceptible of embodiment in various forms, there is shown in the drawings and will hereinafter be described a presently preferred, albeit not limiting, embodiment with the understanding that the present disclosure is to be considered an exemplification of the present invention and is not intended to limit the invention to the specific embodiments illustrated.

Referring to FIGS. 1-4, an illustrative embodiment of an article of clothing wear indicator and/or use counter for tracking the number of times an article of clothing has been worn, referred to generally as a clothing wear tracker 10, is provided. The clothing wear tracker 10 includes an intermediate portion or body 12, an upper portion or body 14, and a lower portion or body 16. Preferably, the clothing wear tracker 10 is configured to allow both the upper portion or body 14 and the lower portion or body 16 to rotate about the intermediate portion or body 12 independently and in the same direction, or in opposite directions. The clothing wear tracker 10 may be configured to allow the intermediate portion or body 12 to rotate relative to either the upper portion or body 14 or the lower portion or body 16. The clothing wear tracker 10 provides a mechanism for tracking the number of times a user wears an article of clothing, such as a shirt, a blouse, pants, or a dress, and is easily attachable or securable to a clothing hanger.

Figure 5:
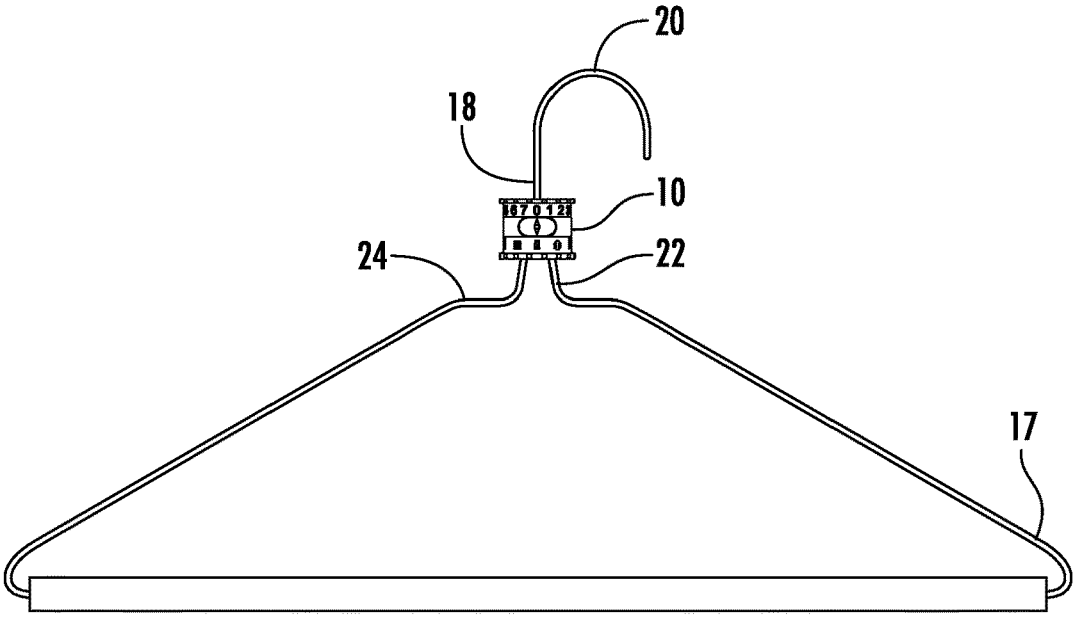
FIG. 5 illustrates the hanger attachable article of clothing wear indicator and/or use counter secured to or engaged with a clothing hanger.
Figure 6:
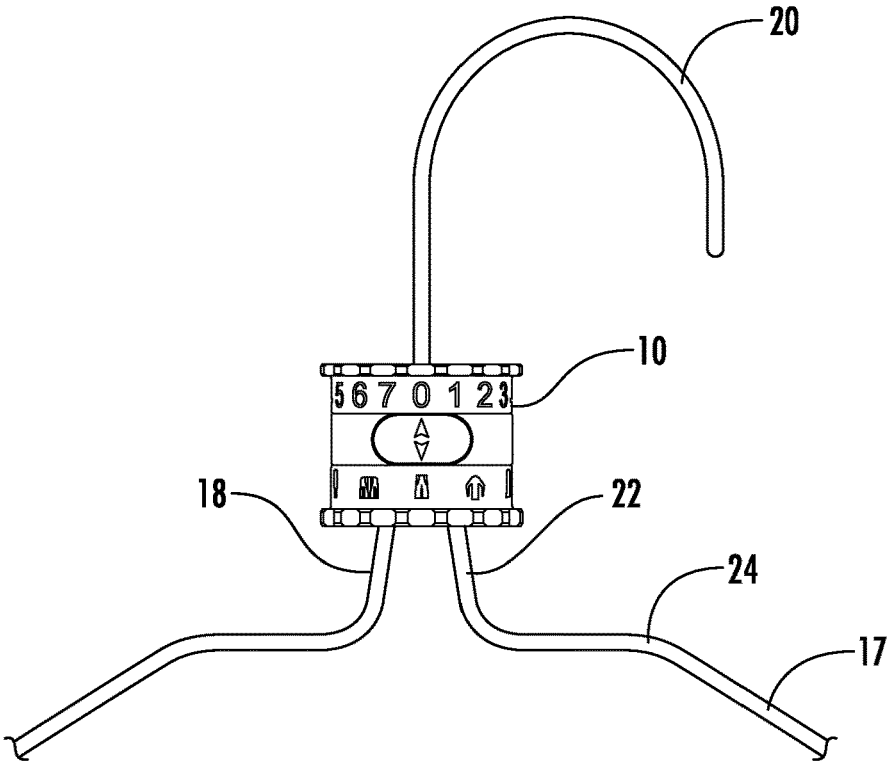
FIG. 6 is a close-up view of the hanger attachable article of clothing wear indicator and/or use counter secured to or engaged with a clothing hanger shown in FIG. 5.

The clothing wear tracker 10 is designed to secure to or fit to/on a clothing hanger 17, preferably at the neck 18 of the hanger hook shaped head 20, see FIGS. 5 and 6. Depending on the size or width of the clothing wear tracker 10, the clothing wear tracker 10 may sit on the seat portion 22 of the hanger shoulders 24 (i.e., where the shoulder 24 begins to form the hanger hook shaped head 20). In this arrangement, a portion of the clothing hanger 17 is inserted within a top opening 26, resting within the clothing wear tracker interior 28.

Referring to FIGS. 7A-11, an illustrative embodiment of the intermediate portion or body 12 is shown. The intermediate portion or body 12 comprises a main unit, illustrated herein as a generally circular shaped main body 30 having a top surface 32, an opposing bottom surface 34, and an outer wall or surface 36 separating the top surface 32 and the opposing bottom surface 34. The intermediate portion main body 30 comprises an opening 38 (extending from the top surface 32 to the opposing bottom surface 34, thereby forming a passageway). The opening 38 is sized and shaped to allow for at least a portion of the clothing hanger 17 to fit within. Extending upwardly and out from the top surface 32 is an upper portion engagement member assembly 40. The upper portion engagement member assembly 40 is designed to engage with or secure the upper portion or body 14 to or with the intermediate portion or body 12. Preferably, the upper portion engagement member assembly 40 is configured to allow the upper portion or body 14 to maintain its positioning with the intermediate portion or body 12, but allow the upper portion or body 14 to rotate thereabout.

The upper portion engagement member assembly 40 comprises a first upper portion engagement member 42 and a second upper portion engagement member 44. The first upper portion engagement member 42 comprises a top end or surface 46, a bottom end 47 integrally formed from or attached to the first top surface 32, and a main body 48. The first upper portion engagement member main body 48 may comprise cut-out portions or channels 50, this forming independent, movable ribs 51A, 51B, and 51C, some of which are movable, i.e., 51A and 51B. The cut-out portions or channels 50 may extend all the way through one end, end 52, leaving the terminal ends 54A, 54B, or 54C free to flex or move up/down. At the opposite end, end 56, the cut-out portions or channels 50 do not extend all the way through.

The second upper portion engagement member 44 comprises a top end or surface 58, a bottom end 60 integrally formed from or attached to the first surface 32, and a main body 62. The second upper portion engagement member main body 62 may comprise cut-out portions or channels 64, this forming independent, movable ribs 66A, 66B, and 66C, some of which are movable or flexible (preferably up/down), i.e., 66A and 66B. The cut-out portions or channels 64 may extend all the way through one end, end 68, leaving the terminal ends 70A, 70B, or 70C free to flex or move up/down, see FIG. 11. At the opposite end, end 72, the cut-out portions or channels 64 do not extend all the way through.

Figure 7A:
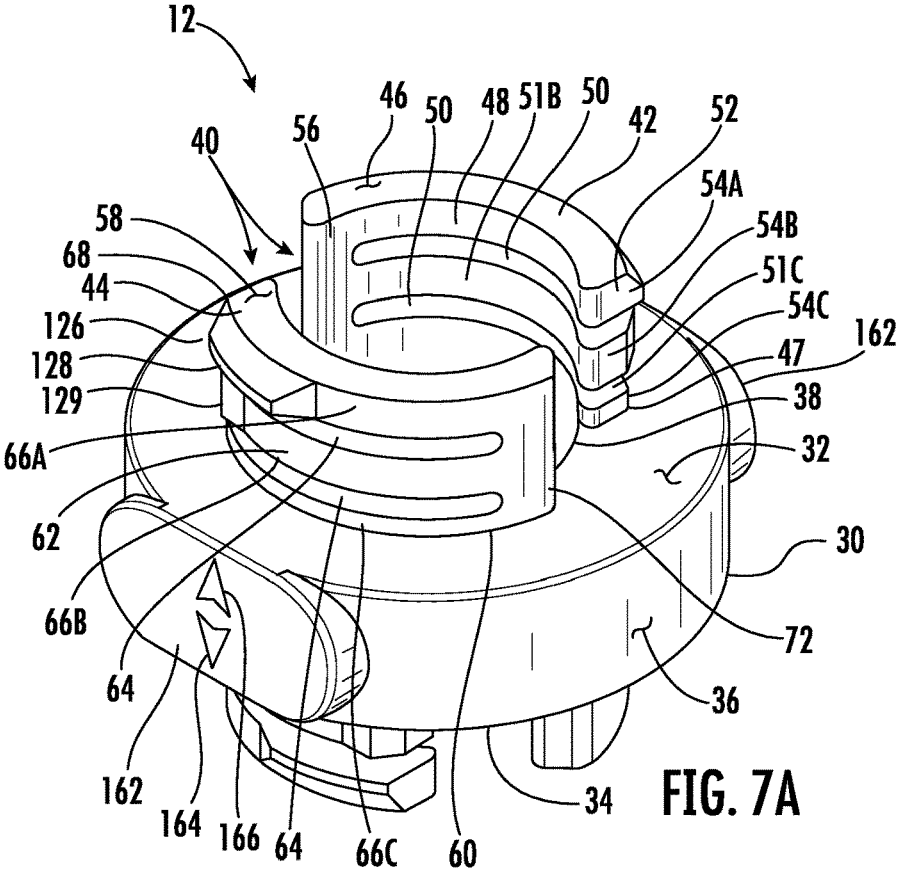
FIG. 7A is a perspective view of the top section of an illustrative embodiment of an intermediate portion or body of the hanger attachable article of clothing wear indicator and/or use counter.

As illustrated in FIG. 7A, the first upper portion engagement member 42 and the second upper portion engagement member 44 assume a semi-curved shape. The first upper portion engagement member 42 and the second upper portion engagement member 44 are also shown positioned along the perimeter of the opening 38, facing each other so the inner curvature forms or defines a portion of the interior 28 of the clothing wear tracker 10. The first upper portion engagement member 42 and the second upper portion engagement member 44 may also be oriented so the terminal ends 54A, 54B, or 54C, are adjacent or opposite end 72 and the terminal ends 70A, 70B, or 70C are adjacent or opposite end 56.

Extending downwardly and away from the bottom surface 34 of the intermediate portion or body 12 is a lower portion engagement member assembly 74. The lower portion engagement member assembly 74 is designed to engage with or secure the lower portion or body 16 to or with the intermediate portion or body 12. Preferably, the lower portion engagement member assembly 74 is configured to allow the lower portion or body 16 to maintain its positioning with the intermediate portion or body 12, but allow the lower portion or body 16 to rotate thereabout.

The lower portion engagement member assembly 74 comprises a first lower portion engagement member 76 and a second lower portion engagement member 78. The first lower portion engagement member 76 comprises a top end or surface 80, a bottom end 82 integrally formed from or attached to the bottom surface 34, and a main body 84. The first lower portion engagement member main body 84 may comprise cut-out portions or channels 88, this forming independent, movable ribs, 90A, 90B, and 90C, some of which are movable or flexible (preferably up/down), i.e., 90A and 90B. The cut-out portions or channels 88 may extend all the way through one end, end 92, leaving the terminal ends 94A, 94B, or 94C free to flex or move up/down. At the opposite end, end 96, the cut-out portions or channels 88 do not extend all the way through.

The second lower portion engagement member 78 comprises a top end or surface 98, a bottom end 100 integrally formed from or attached to the bottom surface 34, and a main body 102. The second lower portion engagement member main body 102 may comprise cut-out portions or channels 104, this forming independent, movable ribs 106A, 106B, and 106C, some of which are movable or flexible (preferably up/down), i.e. 106A and 106B. The cut-out portions or channels 104 may extend all the way through one end, end 108, leaving the terminal ends 110A, 110B, or 110C, see FIG. 11, free to flex or move up/down. At the opposite end, end 112, the cut-out portions or channels 104 do not extend all the way through.

Figure 7B:
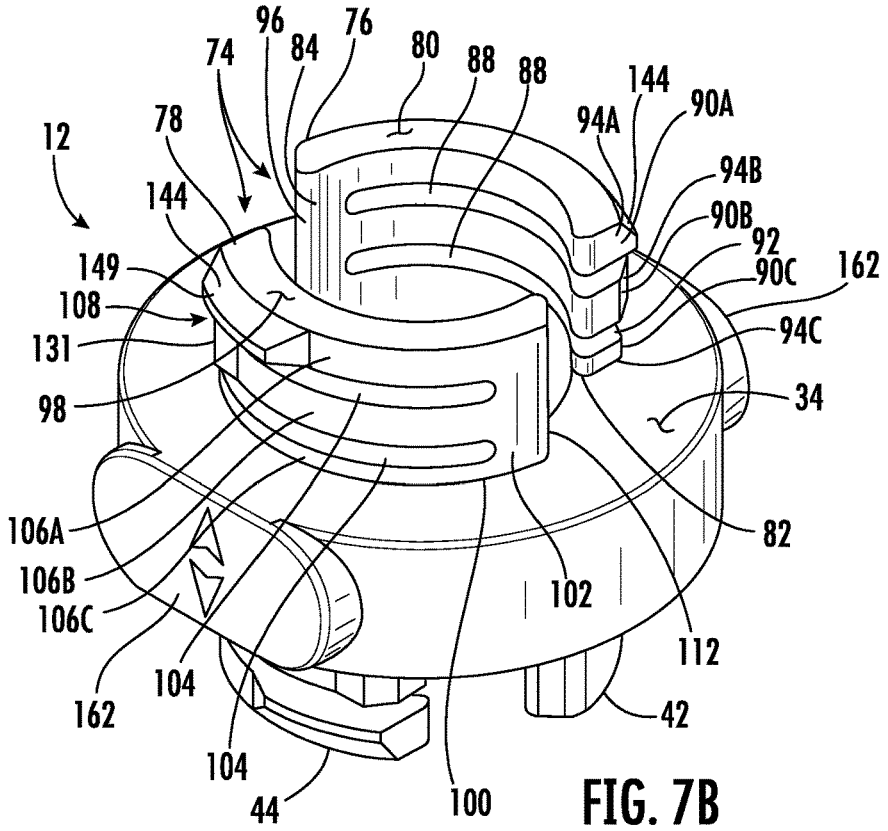
FIG. 7B is a perspective view of a bottom section of the intermediate portion or body of the hanger attachable article of clothing wear indicator and/or use counter.
Figure 8:
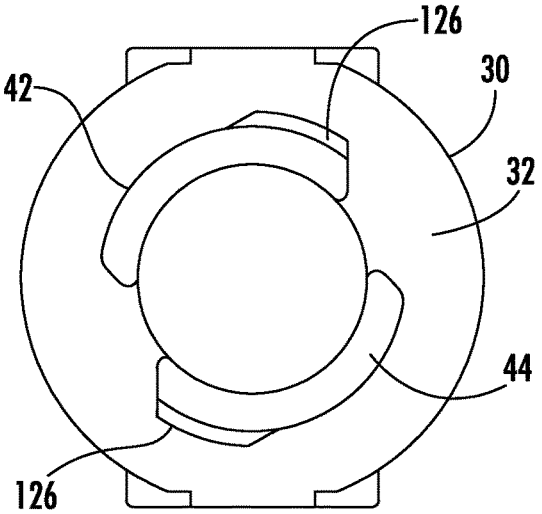
FIG. 8 is a top view of the intermediate portion or body of the hanger attachable article of clothing wear indicator and/or use counter.
Figure 9:
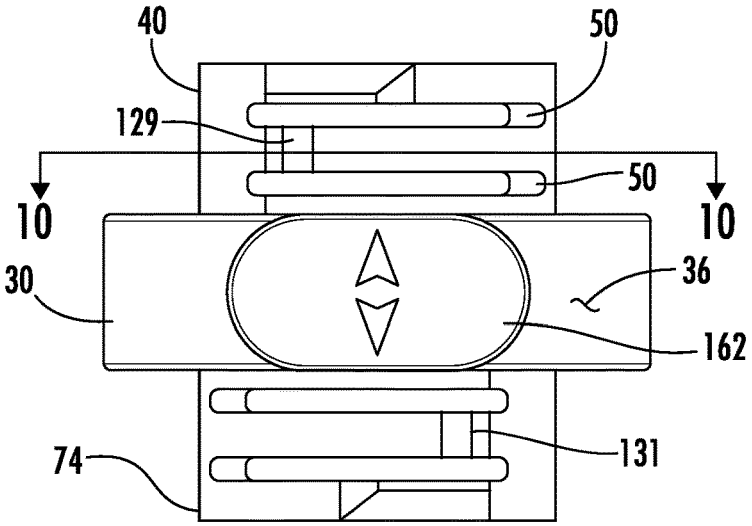
FIG. 9 is a side view of the intermediate portion or body of the hanger attachable article of clothing wear indicator and/or use counter.
Figure 10:
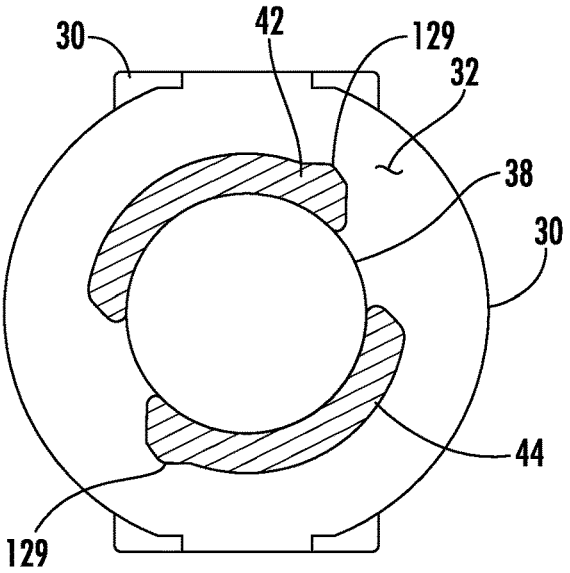
FIG. 10 is a sectional view taken among lines 10-10 of FIG. 9.
Figure 11:
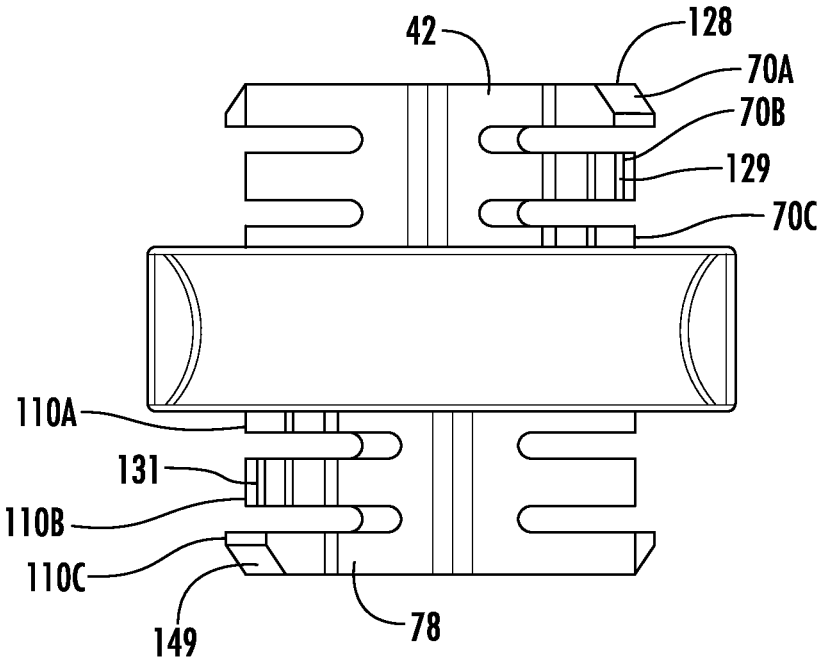
FIG. 11 is an alternative side view of the intermediate portion or body of the hanger attachable article of clothing wear indicator and/or use counter.
Figure 12:
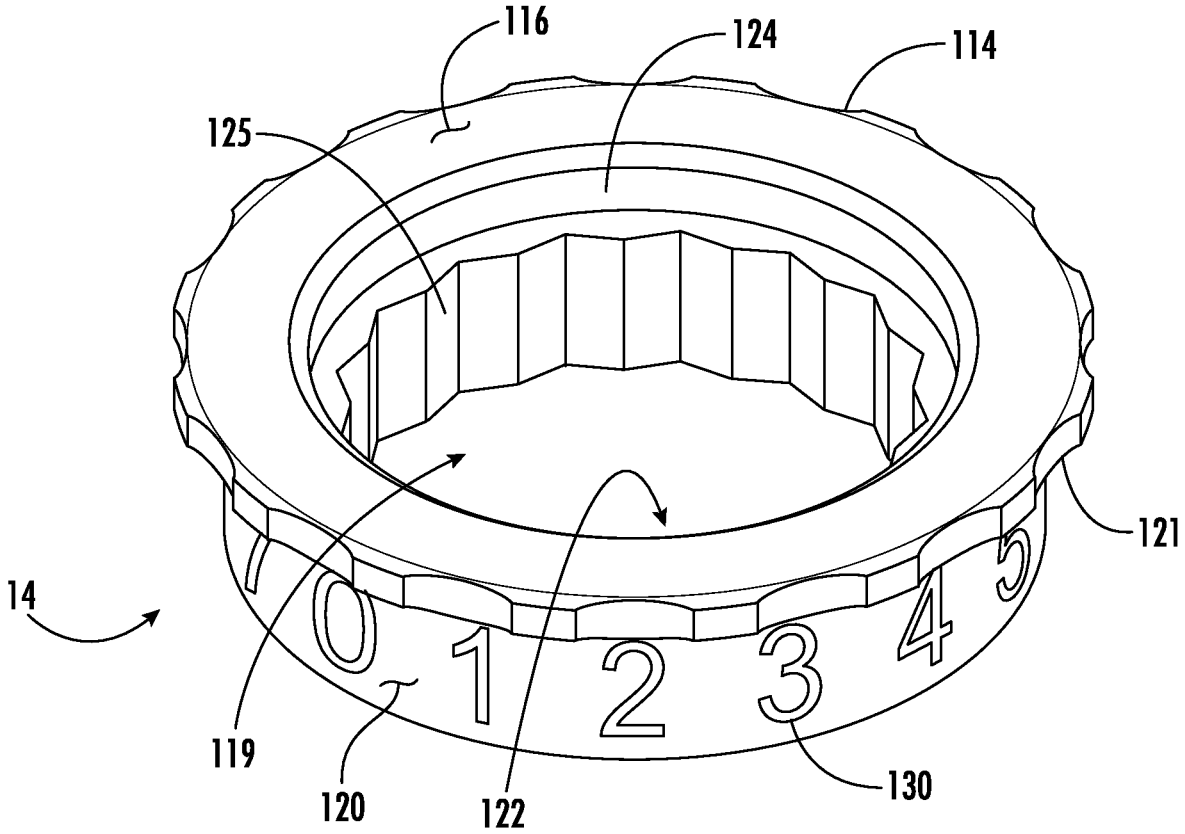
FIG. 12 is a perspective view of an illustrative embodiment of an upper portion or body of the hanger attachable article of clothing wear indicator and/or use counter.
Figure 13:
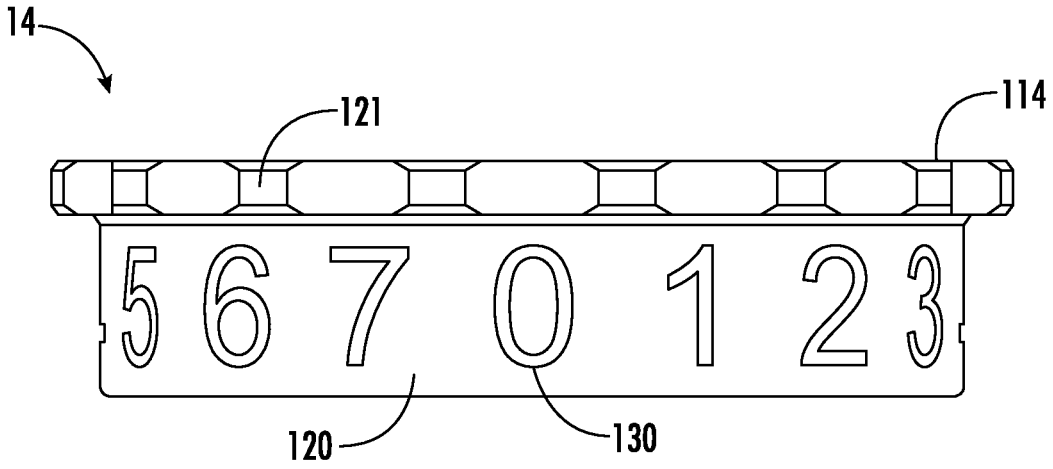
FIG. 13 is a side view of the upper portion or body of the hanger attachable article of clothing wear indicator and/or use counter.
Figure 14:
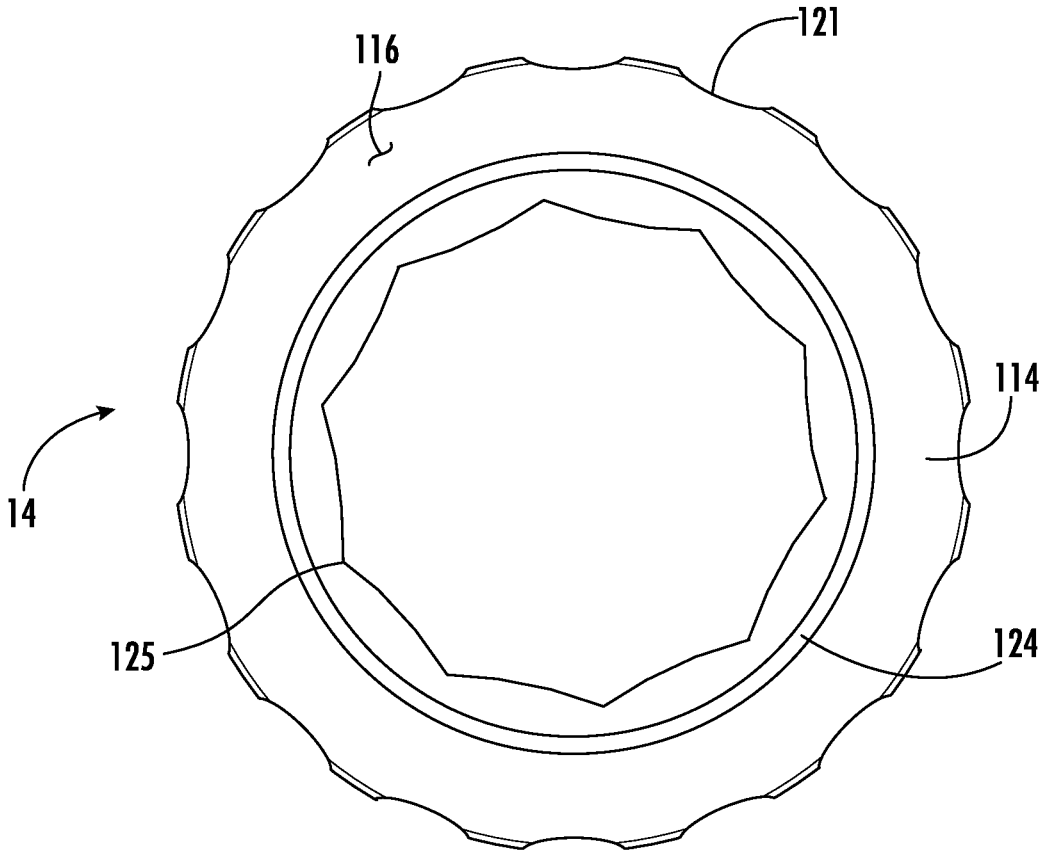
FIG. 14 is a top view of the upper portion or body of the hanger attachable article of clothing wear indicator and/or use counter.
Figure 15:
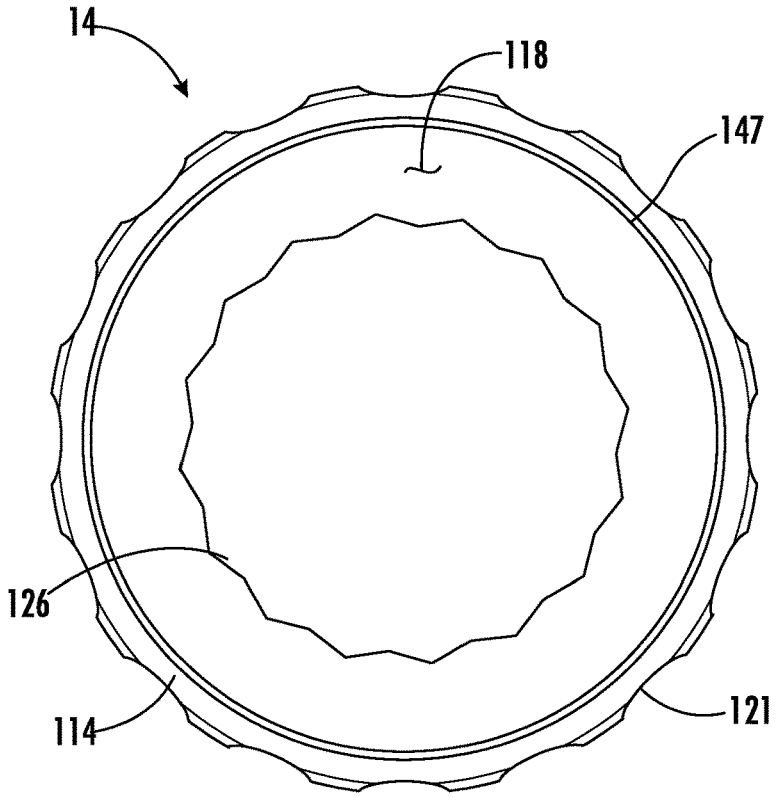
FIG. 15 is a bottom view of the upper portion or body of the hanger attachable article of clothing wear indicator and/or use counter.
Figure 16:
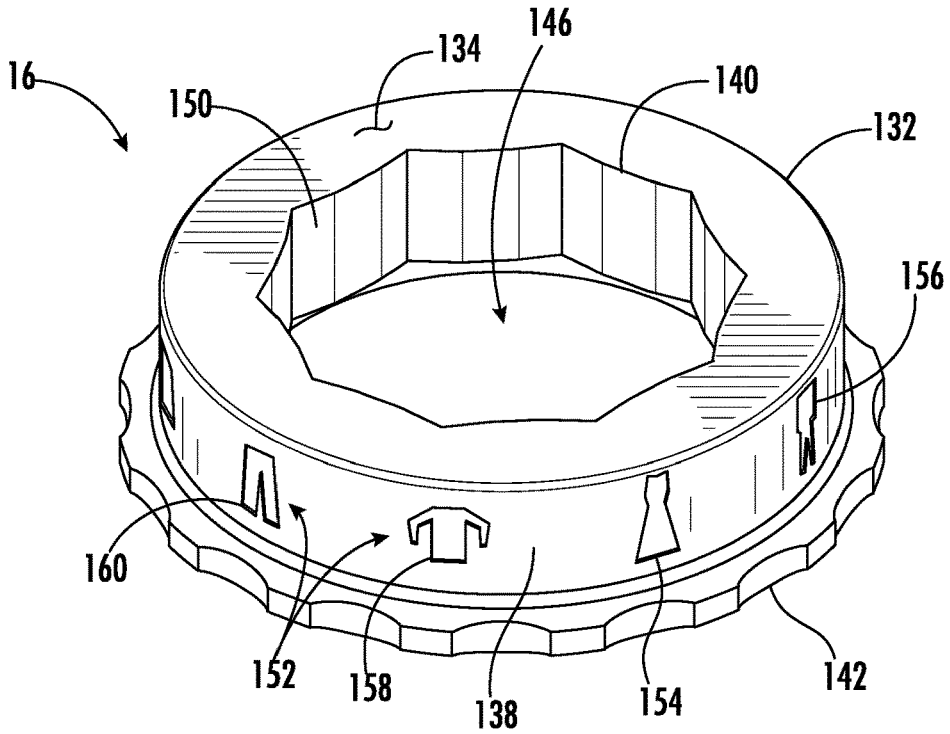
FIG. 16 is a perspective view of an illustrative embodiment of a lower portion or body of the hanger attachable article of clothing wear indicator and/or use counter.
Figure 17:
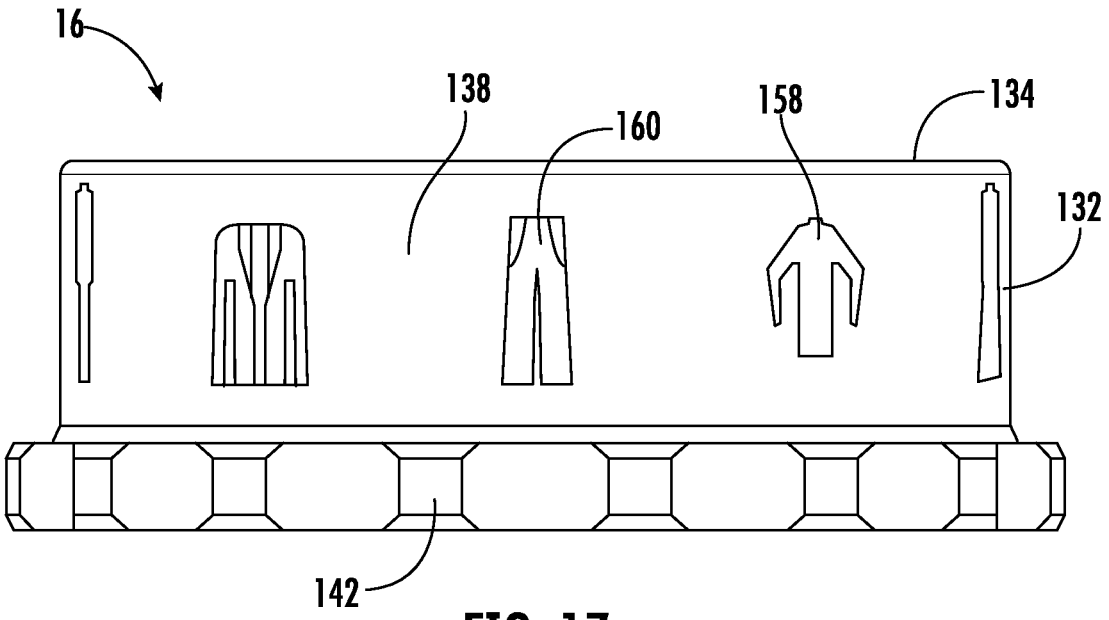
FIG. 17 is a side view of the lower portion or body of the hanger attachable article of clothing wear indicator and/or use counter.
Figure 18:
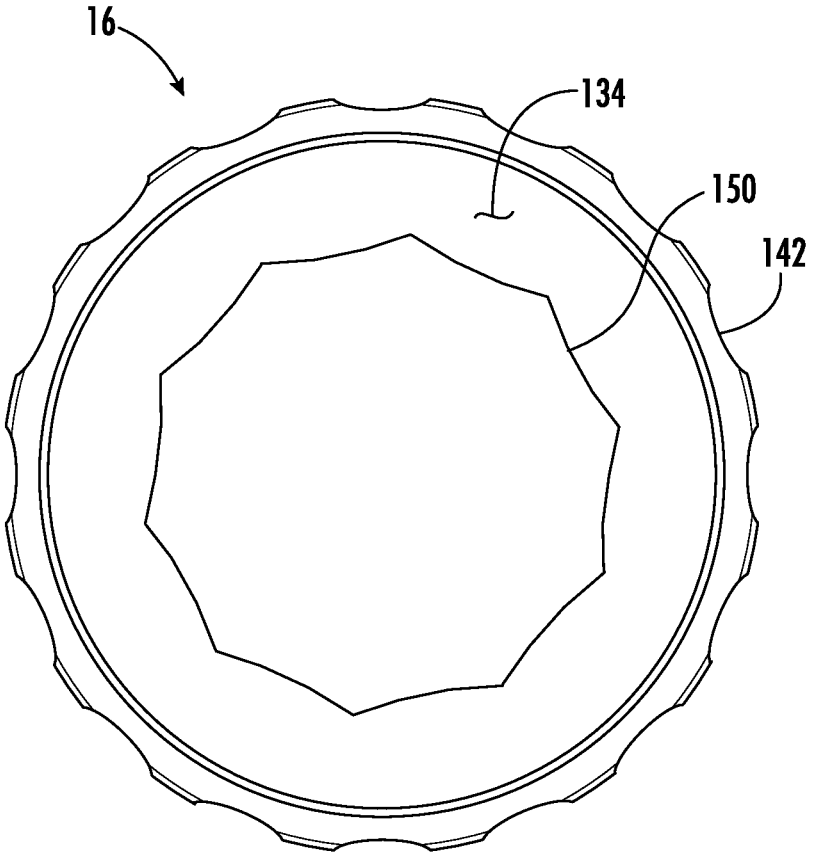
FIG. 18 is a top view of the lower portion or body of the hanger attachable article of clothing wear indicator and/or use counter.
Figure 19:
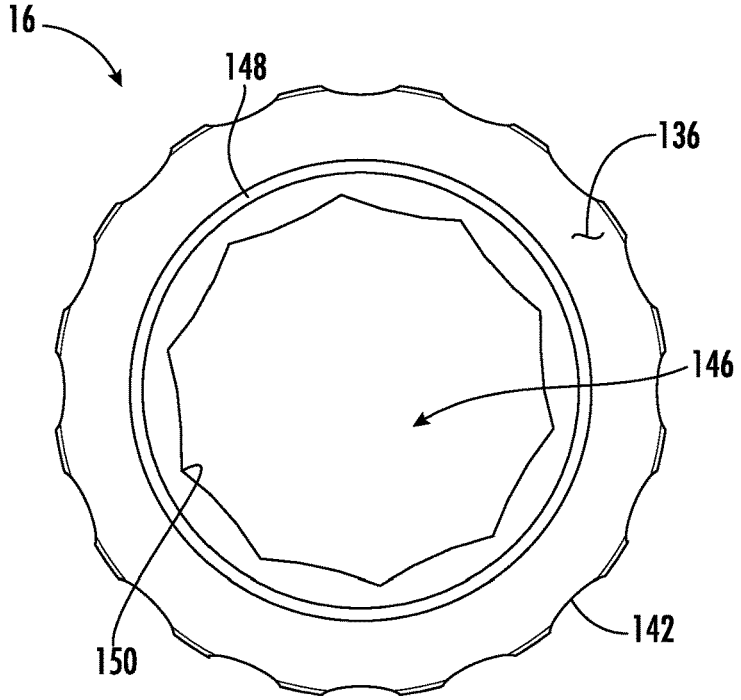
FIG. 19 is a bottom view of the lower portion or body of the hanger attachable article of clothing wear indicator and/or use counter.
Figure 20:
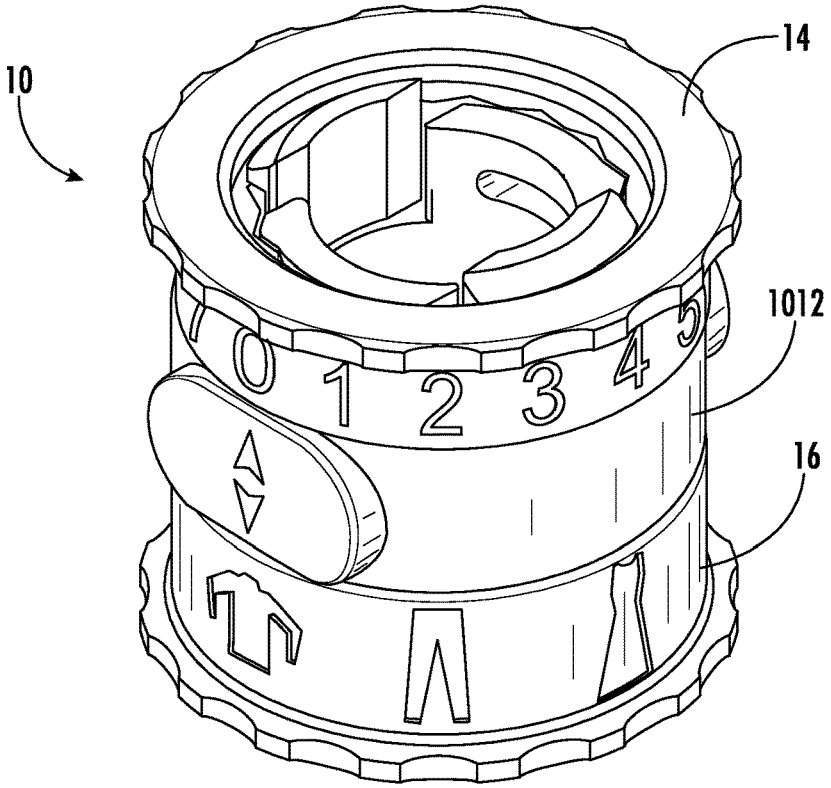
FIG. 20 is a perspective view of an alternative embodiment of the hanger attachable article of clothing wear indicator and/or use counter.
Figure 21:
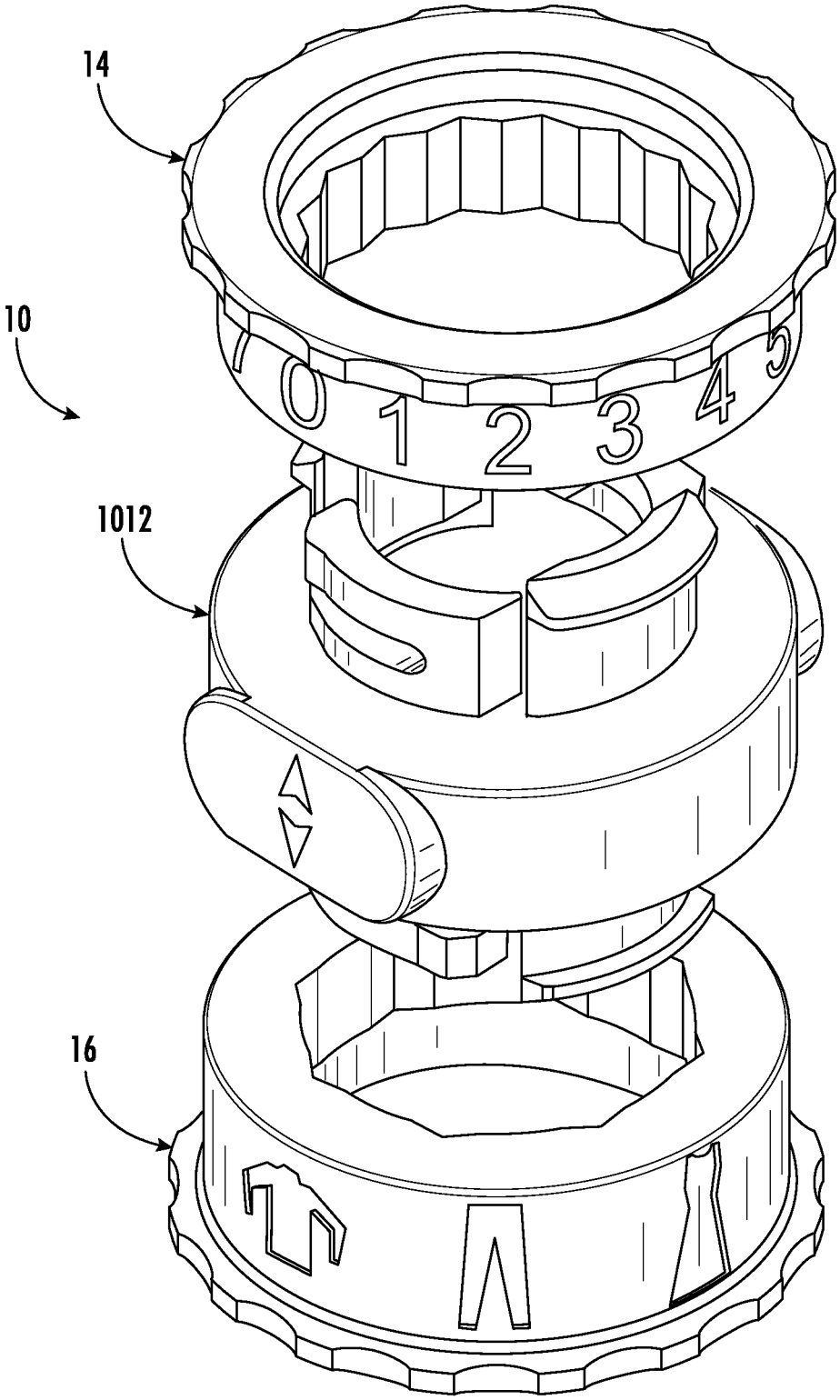
FIG. 21 is an exploded view of the hanger attachable article of clothing wear indicator and/or use counter shown in FIG. 20.
Figure 22A:
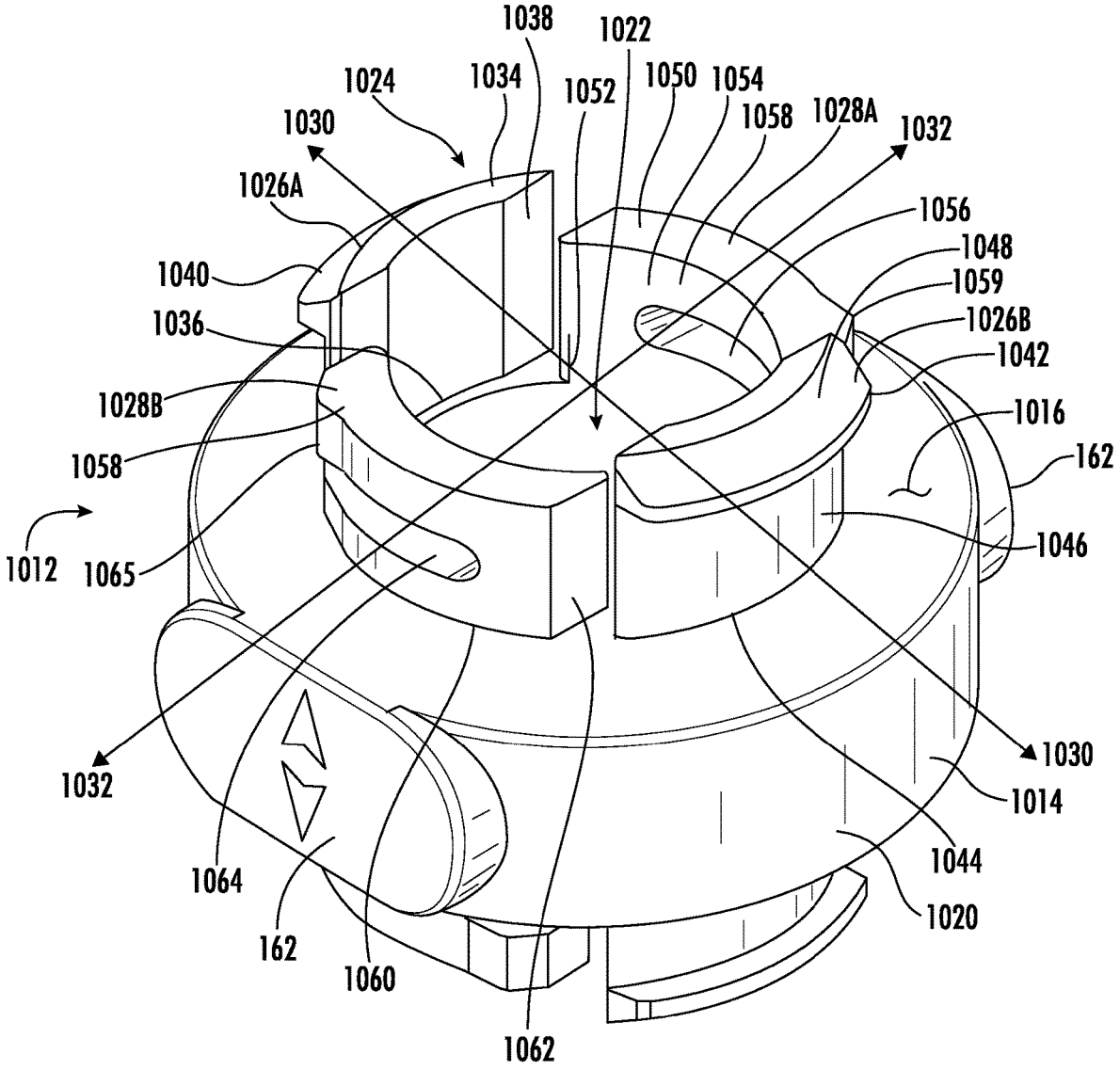
FIG. 22A is a perspective view of the top section of an illustrative embodiment of the intermediate portion or body of the hanger attachable article of clothing wear indicator and/or use counter shown in FIG. 20.
Figure 22B:
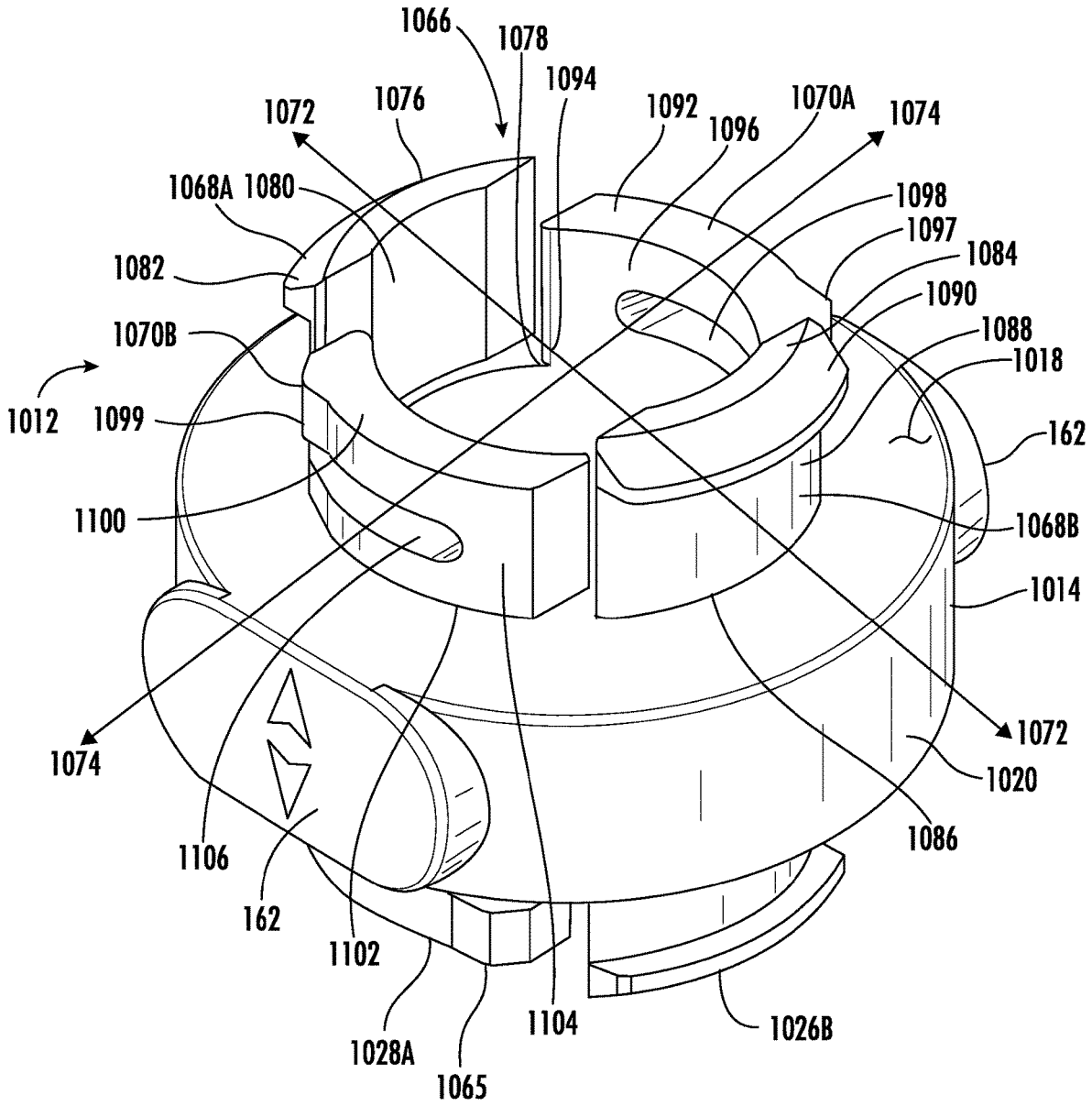
FIG. 22B is a perspective view of the bottom section of the intermediate portion or body of the hanger attachable article of clothing wear indicator and/or use counter shown in FIG. 20.
Figure 23:
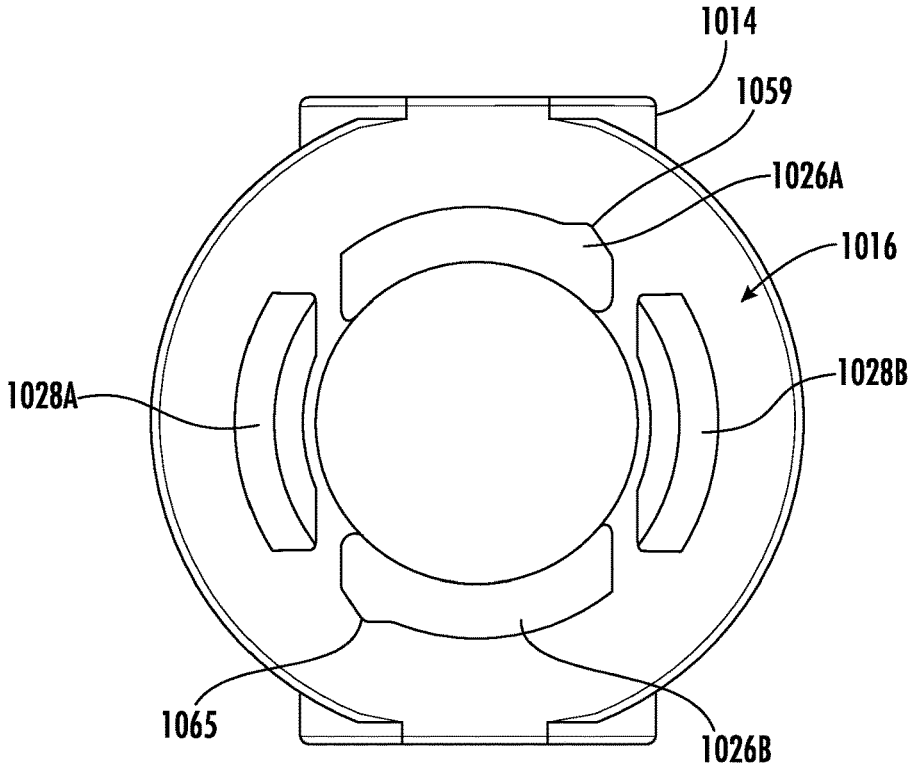
FIG. 23 is a top view of the intermediate portion or body of the hanger attachable article of clothing wear indicator and/or use counter shown in FIG. 20.
Figure 24:
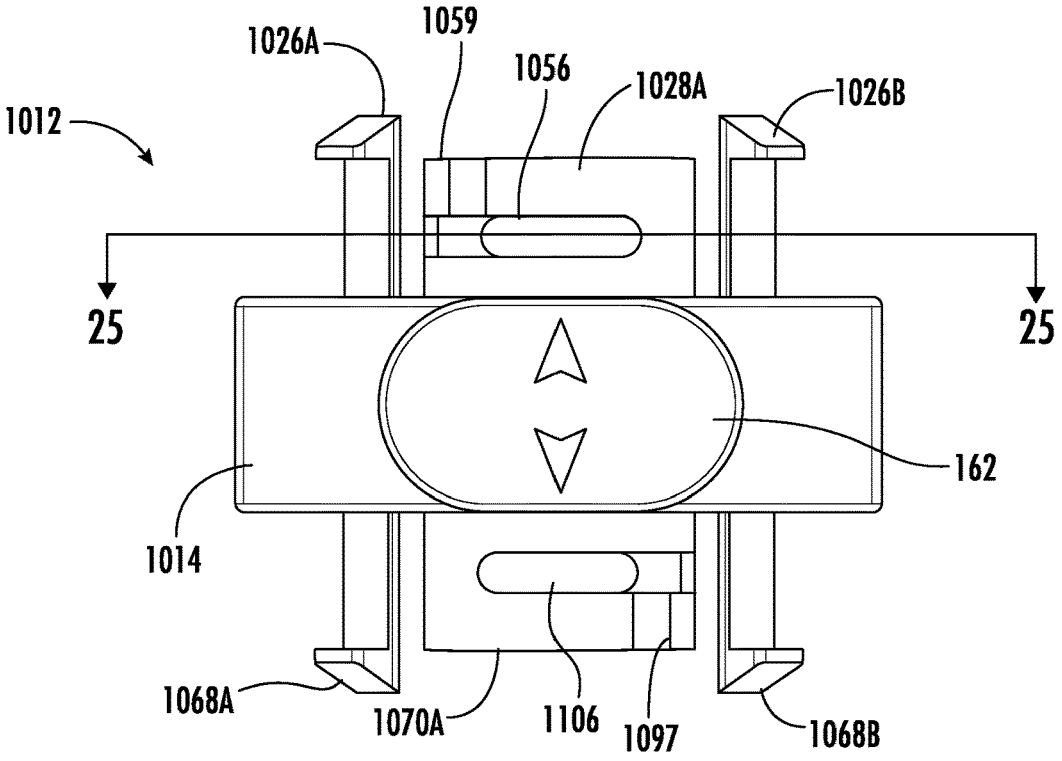
FIG. 24 is a side view of the intermediate portion or body of the hanger attachable article of clothing wear indicator and/or use counter shown in FIG. 20.
Figure 25:
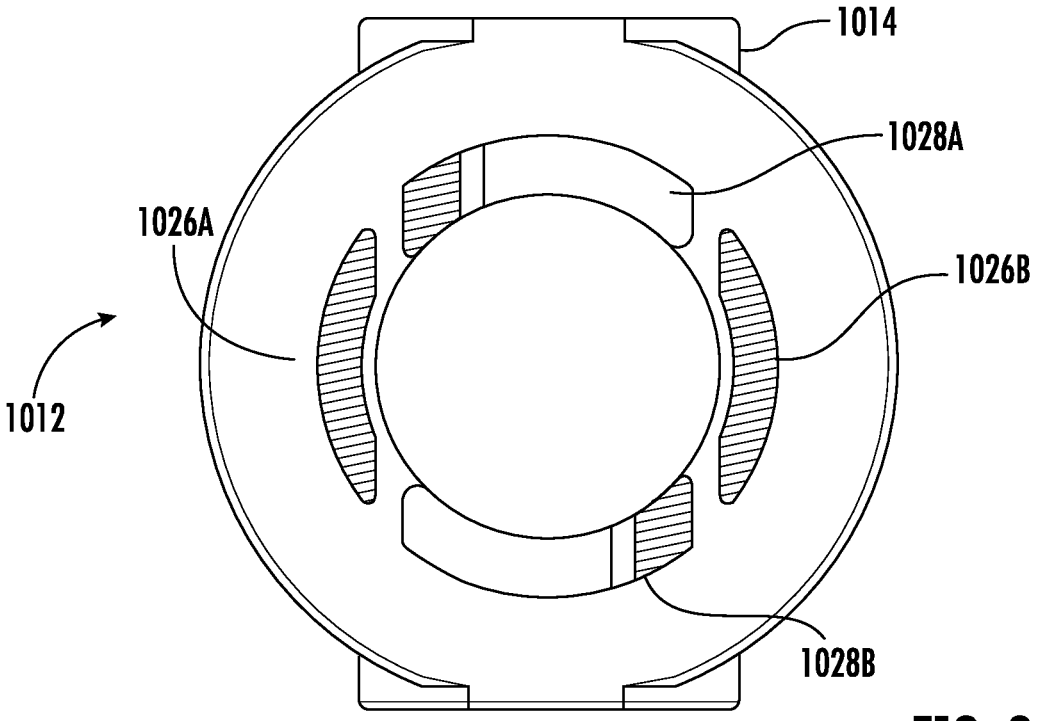
FIG. 25 is a sectional view taken among lines 25-25 of FIG. 24.
Figure 26:
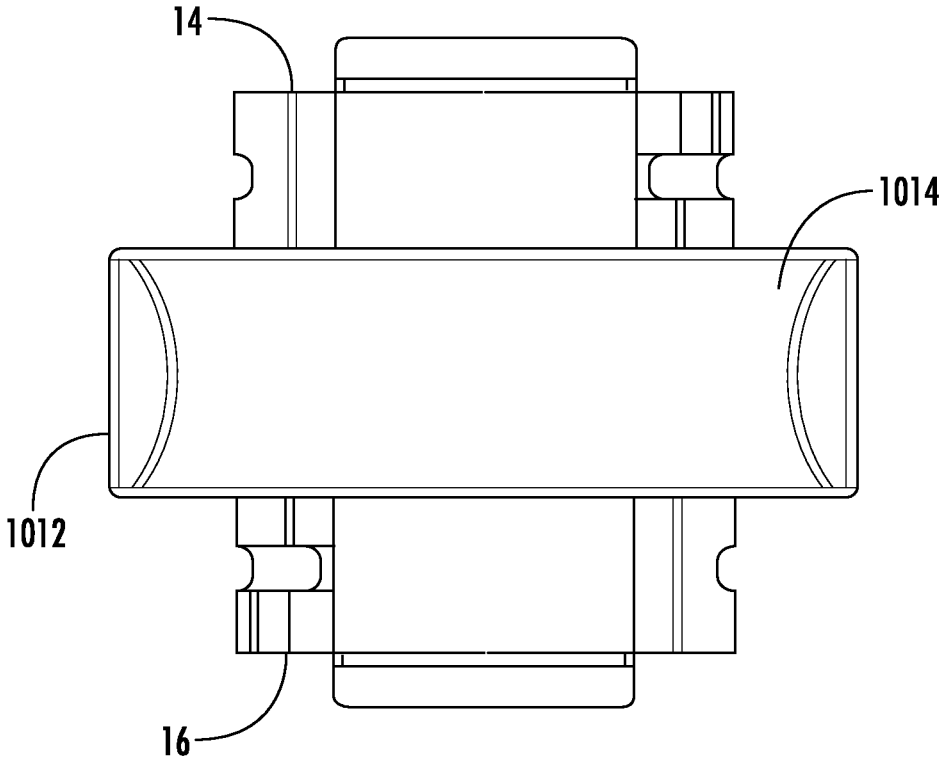
FIG. 26 is an alternative side view of the intermediate portion or body of the hanger attachable article of clothing wear indicator and/or use counter shown in FIG. 20.

As illustrated in FIG. 7B, the first lower portion engagement member 76 and the second lower portion engagement member 78 assume a semi-curved shape. The first lower portion engagement member 76 and the second lower portion engagement member 78 are also shown positioned along the perimeter of the opening 38, facing each other so the inner curvatures form or define a portion of the interior 28 of the clothing wear tracker 10. The first lower portion engagement member 76 and the second lower portion engagement member 78 may also be oriented so the terminal ends 94A, 94B, or 94C are adjacent or opposite end 112 and the terminal ends 110A, 110B, or 110C are adjacent or opposite end 96.

Referring to FIGS. 12-15, an illustrative embodiment of the upper portion or body 14 is shown. The upper portion or body 14 is configured to indicate to a user the number of times an article of clothing has been used, i.e., worn, since it was last cleaned or washed. The upper portion or body 14 may include a main body, referred to herein as a counter ring 114 having a top surface 116, a bottom surface 118, and an intermediate wall or surface 120 separating the top surface 116 and the bottom surface 118. The top surface 116 is sized to extend out past the intermediate wall or surface 120, thus creating an overhang. The size and shape of the bottom surface 118 is configured to cooperate and fit with or rest on surface 32. The counter ring 114 includes an opening 119 sized and shaped to allow for at least a portion of the clothing hanger 17 to fit within.

The outer perimeter of the top surface 116 may include scalloping 121, or other demarcations, that could be used for easy gripping and manipulation (i.e., turning). The internal area 122 of the counter ring 114 may include a seat or ridge 124 and ratcheting mechanism, such as internal V-grooves 125. The internal V-grooves 125 are sized, shaped, and arranged to interact with at least a portion of the upper portion engagement member assembly 40. Specifically, the first upper portion engagement member 42 and the second upper portion engagement member 44 each comprise a counter ring engagement member 126, see FIG. 7A. The counter ring engagement member 126 is configured to engage with and movably lock within the internal V-grooves 125 sections as a user directionally, clockwise or counter-clockwise, turns the upper portion or body 14. The counter ring engagement member 126 may be a tab 128, preferably flexible, extending out and away from the surface. The tab 128 rests within seat 124 and functions to lock the upper portion 14 in place, preventing vertical movement. The tab 128 may include a ramped surface. A protuberance or bump 129 is sized and shaped to mirror the shape of the V-grooves 125, and arranged to fit within, forming a ratchet mechanism. With each of the first upper portion engagement member 42 and the second upper portion engagement member 44 comprising a counter ring engagement member 126, when engaged, the upper portion engagement member assembly 40 has at least two points of contact with the counter ring 114, and thus with the upper portion or body 14.

The intermediate wall or surface 120 is configured to indicate to a user the number of times an article of clothing has been used, i.e., worn, since it was last cleaned or washed. As such, the intermediate wall or surface 120 may include one or more indicia (also referred to as a first article of clothing wear indicator), illustrated herein as numbers 130. While the indicia are illustrated as numbers 130, other symbols, lettering, shapes, colors, individually, or in combination, may also be used.

Referring to FIGS. 16-19, an illustrative embodiment of the lower portion or body 16 is shown. The lower portion or body 16 is configured to indicate to a user a type of article of clothing that is attached to a hanger 17 and requires counting of the times a user has worn that article of clothing since last washing or cleaning. The lower portion or body 16 may include a main body, referred to herein as an article or clothing ring 132 having a top surface 134, a bottom surface 136, and an intermediate wall or surface 138 separating the top surface 134 and the bottom surface 136. The bottom surface 136 is sized to extend out past the intermediate wall or surface 138, thus creating an overhang. The size and shape of the top surface 134 is configured to cooperate and fit with or rest on surface 34. The article or clothing ring 132 includes an opening 140 sized and shaped to allow for at least a portion of the clothing hanger 17 to fit within.

The outer perimeter of the bottom surface 136 may include scalloping 142, or other demarcations, that could be used for easy gripping and manipulation (i.e., turning). An internal area 146 of the article or clothing ring 132 may include a seat or ridge 147 and an internal ratcheting mechanism, such as internal V-grooves 150. The internal V-grooves 150 are sized, shaped, and arranged to interact with at least a portion of the lower portion engagement member assembly 74. Specifically, the first lower portion engagement member 76 and the second lower portion engagement member 78 each comprise an article or clothing ring engagement member 144, see FIG. 7B. The article or clothing ring engagement member 144 is configured to engage with and movably lock within the internal V-grooves 150 sections as a user directionally, clockwise or counter-clockwise, turns the lower portion or body 16. The article or clothing ring engagement member 144 may be a tab 149, preferably flexible, extending out and away from the surface. The tab 149 rests within seat 147 and functions to lock the lower portion 16 in place, preventing vertical movement. The tab 149 may include a ramped surface. A protuberance or bump 131 is sized and shaped to mirror the shape of the V-grooves 150, and arranged to fit within, forming a ratchet mechanism.

With each of the first lower portion engagement member 76 and the second lower portion engagement member 78 comprising an article or clothing ring engagement member 126, 144, when engaged, the lower portion engagement member assembly 74 has at least two points of contact with the article or clothing ring engagement member 144, and thus with the lower portion or body 16.

The intermediate wall or surface 138 is configured to provide indication to a user the type of article of clothing that is attached to the hanger and being counted for number of use or wear times since the last washing or cleaning. As such, the intermediate wall or surface 138 may include one or more indicia 152 (also referred to as a second article of clothing wear indicator), illustrated herein as pictures representing articles of clothing, such as a dress 154, a suit 156, a shirt 158, or pants 160. While the indicia 152 is illustrated as articles of clothing, other symbols, lettering, shapes, colors, individually, or in combination, may also be used.

Figure 2:
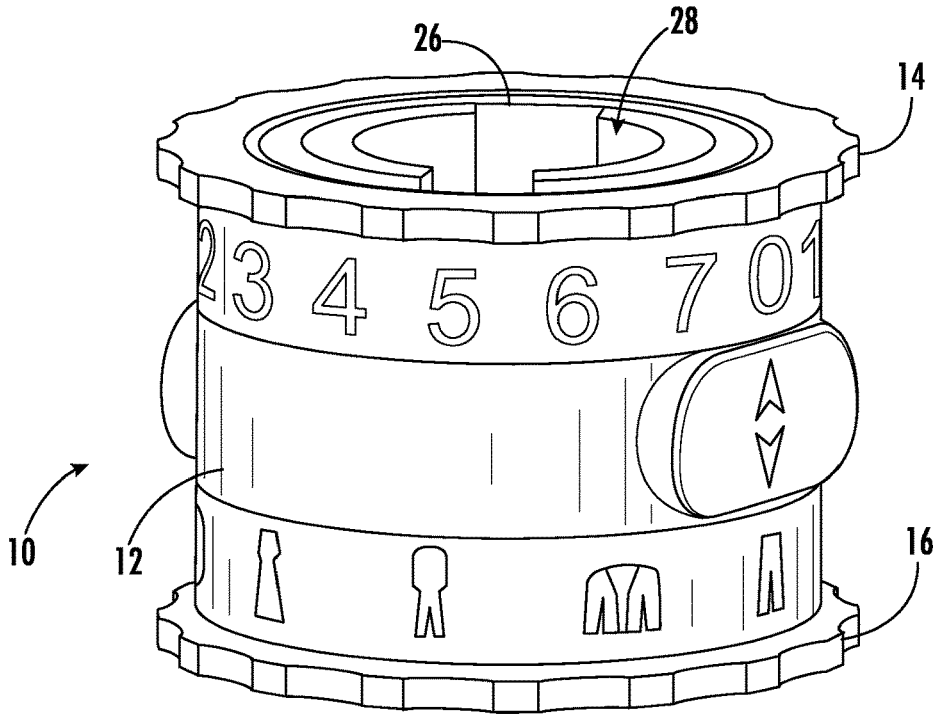
FIG. 2 is an alternative perspective view of the hanger attachable article of clothing wear indicator and/or use counter.
Figure 3:
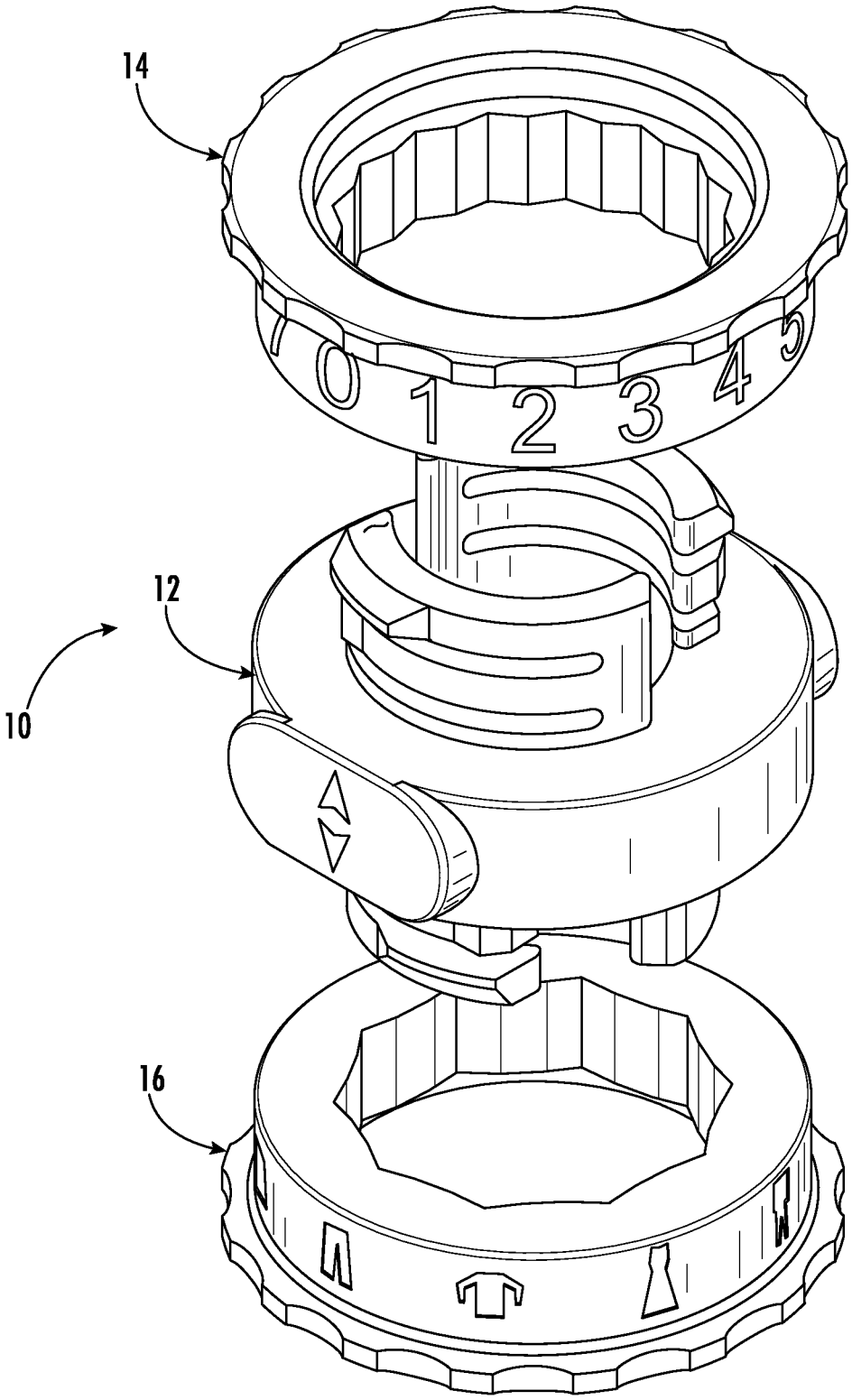
FIG. 3 is an exploded view of the hanger attachable article of clothing wear indicator and/or use counter.
Figure 4:
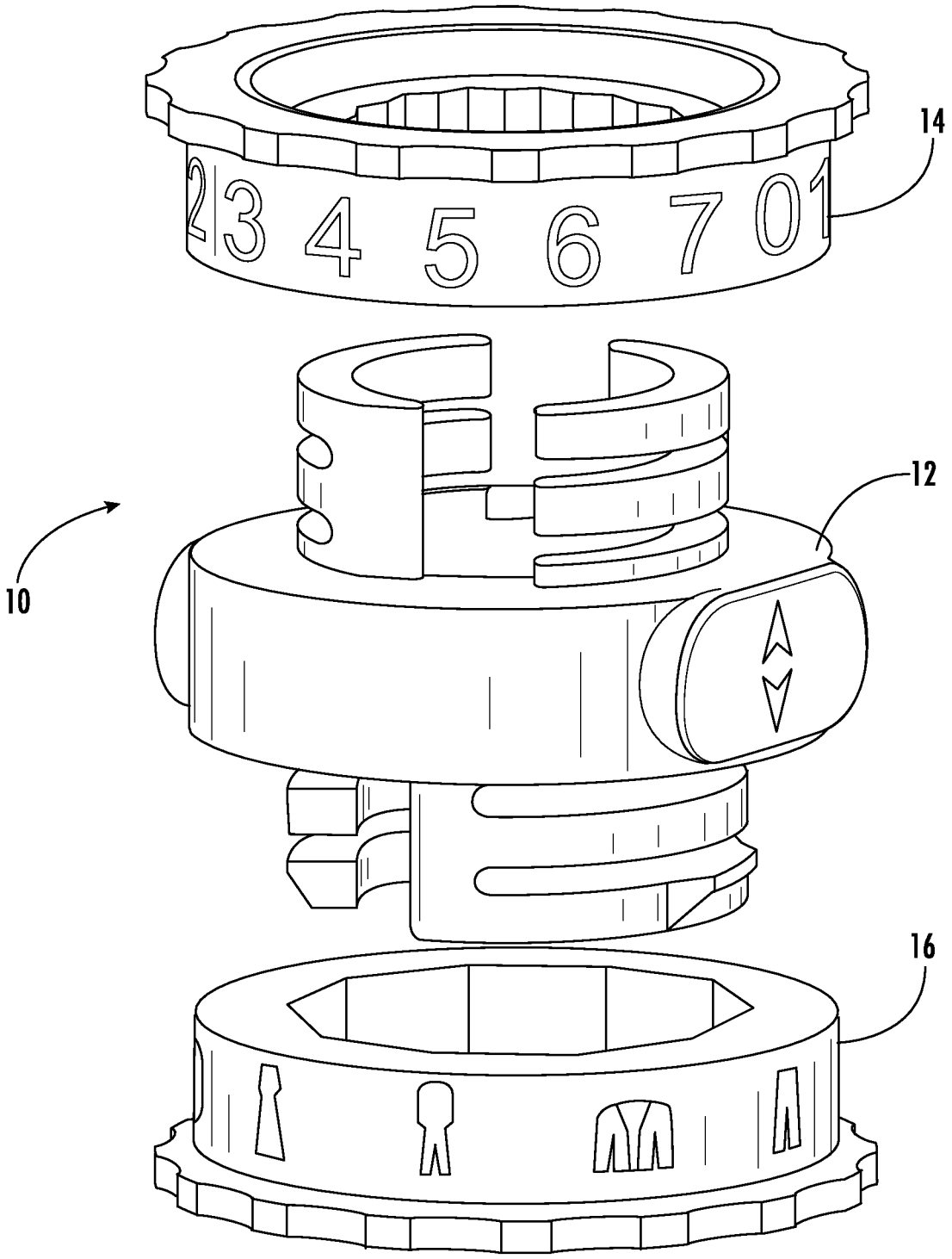
FIG. 4 is an alternative exploded view of the hanger attachable article of clothing wear indicator and/or use counter.

The intermediate member 12 preferably includes one or more dual article of clothing wear indicators, referred to generally as a dual article of clothing wear indicator 162. The dual article of clothing wear indicator 162 is designed to allow a user to view both the number of times an article of clothing indicia (i.e. numbers 130) and the type of article of clothing indicia (i.e., pants 160) are chosen. This allows the user to see the number of times an article of clothing has been used prior to a last washing or cleaning. For example, as shown in FIGS. 1 and 2, the user has chosen the number "0" and the picture or symbol of pants. This indicates that the pants that are hanging on the hanger, see FIGS. 5 and 6, have not been worn (or have been worn zero times) since the last cleaning. The dual article of clothing wear indicator 162 may include visual indicators, illustrated as a down-facing arrowhead 164, and an up-facing arrowhead 166. Although illustrated with two dual article of clothing wear indicators 162, the clothing wear tracker 10 may have one or more than two. In an illustrative embodiment, the clothing wear tracker 10 includes two dual article of clothing wear indicators 162, where the first dual article of clothing wear indicator is positioned on the intermediate body one-hundred eighty degrees from the second dual article of clothing wear indicator. If the indicia, the number of times an article of clothing indicia (i.e. numbers 130) and the type of article of clothing indicia (i.e., 160) is arranged in duplicate (i.e., two number zeros, two number 1s, two pants, two dresses) and 180 degrees from the duplicate, when in use, the user is able to see and obtain the same information when looking at the clothing wear tracker 10 (coupled to the hanger) from the front and the back.

Referring to FIGS. 20-26, an alternative embodiment of the clothing wear tracker 10 is provided. The clothing wear tracker 10 illustrated in these figures uses the same upper portion or body 14 and lower portion or body 16 as described above. As such, description of these components will not be provided. In addition, the clothing wear tracker 10 shown in these figures has the same functions as described above; that is, the clothing wear tracker 10 is configured to allow both the upper portion or body 14 and the lower portion or body 16 to rotate about the intermediate portion or body 12 independently and in the same direction, or in opposite directions, or allow the intermediate portion or body 12 to rotate relative to either the upper portion or body 14 or the lower portion or body 16. The clothing wear tracker 10 provides a mechanism for tracking the number of times a user wears an article of clothing, such as a shirt, a blouse, pants, or a dress, and is easily attachable or securable to a clothing hanger 17. The clothing wear tracker 10 shown in FIGS. 20-26 comprises an intermediate portion or body, but differs in its construction, and will be referred to generally as intermediate portion or body 1012.

The intermediate portion or body 1012 comprises a main unit, illustrated herein as a generally circular shaped main body 1014 having a top surface 1016, an opposing bottom surface 1018, and an outer surface or wall 1020 separating the top surface 1016 and the opposing bottom surface 1018. The intermediate portion main body 1014 comprises an opening 1022. The opening 1022 is sized and shaped to allow for at least a portion of the clothing hanger 17 to fit within. Extending upwardly and out from the top surface 1016 is an upper portion engagement member assembly 1024. The upper portion engagement member assembly 1024 is designed to engage with or secure the upper portion or body 14 to or with the intermediate portion or body 1012. Preferably, the upper portion engagement member assembly 1024 is configured to allow the upper portion or body 14 to maintain its positioning with the intermediate portion or body 1012, but allow the upper portion or body 14 to rotate thereabout.

The upper portion engagement member assembly 1024 comprises a first upper portion engagement member 1026A, a second upper portion engagement member 1026B, a third upper portion engagement member 1028A, and a fourth upper portion engagement member 1028B. The first upper portion engagement member 1026A and the second upper portion engagement member 1026B are arranged in a parallel manner relative to each other and within the same plane or longitudinal axis 1030. The third upper portion engagement member 1028A and the fourth upper portion engagement member 1028B are arranged in a parallel manner relative to each other and within the same plane or longitudinal axis 1032. The plane or longitudinal axis 1032 is different from that of plane or longitudinal axis 1030.

The first upper portion engagement member 1026A comprises a top end or surface 1034, a bottom end 1036 integrally formed from or attached to the top surface 1016, and a main body 1038. The first upper portion engagement member main body 1038 may comprise an angled tab 1040 extending out and angled from the top end or surface 1034 and functioning to lock the lower portion 16 in place, preventing vertical movement. The second upper portion engagement member 1026B comprises a top end or surface 1042, a bottom end 1044 integrally formed from or attached to the top surface 1016, and a main body 1046. The second upper portion engagement member main body 1046 may comprise an angled tab 1048 extending out and angled from the top end or surface 1042 and functioning to lock the lower portion 16 in place, preventing vertical movement. The angled tab 1048 is orientated to face a direction that is opposite of the direction of angled tab 1040.

The third upper portion engagement member 1028A comprises a top end or surface 1050, a bottom end 1052, integrally formed from or attached to the first top surface 1016, and a main body 1054. The third upper portion engagement member main body 1054 may comprise cut-out portions or channels 1056, this forming independent, movable ribs. The cut-out portions or channels 1056 may extend all the way through one end, leaving the terminal ends free to flex or move up/down. At the opposite end, the cut-out portions or channels 1056 do not extend all the way through. The third upper portion engagement member 1028A may include a protuberance or bump 1059 sized and shaped to mirror the shape of V-grooves 150, and arranged to fit within, forming a ratchet mechanism.

The fourth upper portion engagement member 1028B comprises a top end or surface 1058, a bottom end 1060, integrally formed from or attached to the top surface 1016, and a main body 1062. The fourth upper portion engagement member main body 1062 may comprise cut-out portions or channels 1064, this forming independent, movable ribs. The cut-out portions or channels 1064 may extend all the way through one end, leaving the terminal ends free to flex or move up/down. At the opposite end, the cut-out portions or channels 1056 do not extend all the way through. The fourth upper portion engagement member 1028B may include a protuberance or bump 1065 sized and shaped to mirror the shape of V-grooves 150, and arranged to fit within, forming a ratchet mechanism.

Extending upwardly and out from the bottom surface 1018 of the intermediate portion or body 1012 is a lower portion engagement member assembly 1066. The lower portion engagement member assembly 1066 is designed to engage with or secure the lower portion or body 16 to or with the intermediate portion or body 1012. Preferably, the lower portion engagement member assembly 1066 is configured to allow the lower portion or body 14 to maintain its positioning with the intermediate portion or body 1012, but allow the lower portion or body 16 to rotate thereabout.

The lower portion engagement member assembly 1066 comprises a first lower portion engagement member 1068A, a second lower portion engagement member 1068B, a third lower portion engagement member 1070A, and a fourth lower portion engagement member 1070B. The first lower portion engagement member 1068A and the second lower portion engagement member 1068B are arranged in a parallel manner relative to each other and within the same plane or longitudinal axis 1072. The third lower portion engagement member 1070A and the fourth lower portion engagement member 1070B are arranged in a parallel manner relative to each other and within the same plane or longitudinal axis 1074. The plane or longitudinal axis 1074 is different from that of plane or longitudinal axis 1072.

The first lower portion engagement member 1068A comprises a top end or surface 1076, a bottom end 1078 integrally formed from or attached to the opposing, bottom surface 1018, and a main body 1080. The first lower portion engagement member main body 1080 may comprise an angled tab 1082 extending out and angled from the top end or surface 1076 and functioning to lock the upper portion 14 in place, preventing vertical movement. The second lower portion engagement member 1068B comprises a top end or surface 1084, a bottom end 1086 integrally formed from or attached to the surface 1018, and a main body 1088. The second lower portion engagement member main body 1088 may comprise an angled tab 1090 extending out and angled from the top end or surface 1084 and functioning to prevent vertical movement. The angled tab 1084 is orientated to face a direction that is opposite of the direction of angled tab 1082.

The third lower portion engagement member 1070A comprises a top end or surface 1092, a bottom end 1094 integrally formed from or attached to the surface 1018, and a main body 1096. The third lower portion engagement member main body 1096 may comprise cut-out portions or channels 1098, this forming independent, movable ribs. The cut-out portions or channels 1098 may extend all the way through one end, leaving the terminal ends free to flex or move up/down. At the opposite end, the cut-out portions or channels 1098 do not extend all the way through. The third lower portion engagement member 1070A may include a protuberance or bump 1097 sized and shaped to mirror the shape of V-grooves 150, and arranged to fit within, forming a ratchet mechanism.

The fourth lower portion engagement member 1070B comprises a top end or surface 1100, a bottom end 1102 integrally formed from or attached to the surface 1018, and a main body 1104. The fourth lower portion engagement member main body 1104 may comprise cut-out portions or channels 1106, this forming independent, movable ribs. The cut-out portions or channels 1106 may extend all the way through one end, leaving the terminal ends free to flex or move up/down. At the opposite end, the cut-out portions or channels 1106 do not extend all the way through. The fourth lower portion engagement member 1070B may include a protuberance or bump 1099 sized and shaped to mirror the shape of V-grooves 150, and arranged to fit within, forming a ratchet mechanism.

All patents and publications mentioned in this specification are indicative of the levels of those skilled in the art to which the invention pertains. All patents and publications are herein incorporated by reference to the same extent as if each individual publication was specifically and individually indicated to be incorporated by reference.

It is to be understood that while a certain form of the invention is illustrated, it is not to be limited to the specific form or arrangement herein described and shown. It will be apparent to those skilled in the art that various changes may be made without departing from the scope of the invention and the invention is not to be considered limited to what is shown and described in the specification and any drawings/figures included herein.

One skilled in the art will readily appreciate that the present invention is well adapted to carry out the objectives and obtain the ends and advantages mentioned, as well as those inherent therein. The embodiments, methods, procedures and techniques described herein are presently representative of the preferred embodiments, are intended to be exemplary, and are not intended as limitations on the scope. Changes therein and other uses will occur to those skilled in the art which are encompassed within the spirit of the invention and are defined by the scope of the appended claims. Although the invention has been described in connection with specific preferred embodiments, it should be understood that the invention as claimed should not be unduly limited to such specific embodiments. Indeed, various modifications of the described modes for carrying out the invention which are obvious to those skilled in the art are intended to be within the scope of the following claims.

What is claimed is:

1. An article of clothing wear indicator, comprising:

an intermediate body having a top surface, an opposing bottom surface, and a wall separating said top surface and said opposing bottom surface, said intermediate body having an opening extending from said top surface to said opposing bottom surface, thereby forming an passageway, said passageway and said intermediate body opening both sized and shaped to allow for at least a portion of a clothing hanger to fit within, said intermediate body further comprising an upper body engagement member assembly and a lower body engagement member assembly;

an upper portion having a main body having a top surface, a bottom surface, and an intermediate wall or surface separating said top surface and said bottom surface, said upper portion main body intermediate wall or surface having a first article of clothing wear indicator; and a lower portion having a main body having a top surface, a bottom surface, and an intermediate wall or surface separating said top surface and said bottom surface, said lower portion main body intermediate wall or surface having a second article of clothing wear indicator.

2. The article of clothing wear indicator according to claim 1, wherein said first article of clothing wear indicator is configured to indicate a number of times an article of clothing has been worn or to indicate a type of article of clothing.

3. The article of clothing wear indicator according to claim 1, wherein said second article of clothing wear indicator is configured to indicate a type of article of clothing or to indicate a number of times an article of clothing has been worn.

4. The article of clothing wear indicator according to claim 1, wherein said upper portion and said lower portion are coupled to said intermediate portion, wherein when coupled, said upper portion rotates about said intermediate portion independently from said lower portion, and said lower portion rotates about said intermediate portion independently from said upper portion.

5. The article of clothing wear indicator according to claim 1, wherein said upper body engagement member is configured to couple with said upper portion body, wherein when coupled, said upper portion body maintains its positioning relative to said intermediate body, but allows said upper portion body to rotate thereabout.

6. The article of clothing wear indicator according to claim 1, wherein said upper body engagement member is configured to couple with said upper portion body, wherein when coupled, said upper portion body maintains its positioning relative to said intermediate body, but allows said intermediate portion to rotate about said upper portion body.

7. The article of clothing wear indicator according to claim 1, wherein said lower body engagement member is configured to couple with said lower portion body, wherein when coupled, said lower portion body maintains its positioning relative to said intermediate body, but allows said lower portion body to rotate thereabout.

8. The article of clothing wear indicator according to claim 1, wherein said lower body engagement member is configured to couple with said lower portion body, wherein when coupled, said lower portion body maintains its positioning relative to said intermediate body, but allows said intermediate portion to rotate about said lower portion body.

9. The article of clothing wear indicator according to claim 1, wherein, said upper body engagement assembly includes two independent and separated bodies extending away from said intermediate member top surface; and said lower body engagement assembly includes two independent and separated bodies extending away from said intermediate member lower surface.

10. The article of clothing wear indicator according to claim 1, wherein, said upper body engagement assembly includes four independent and separated upper portion engagement members extending away from said intermediate member top surface; and said lower body engagement assembly includes four independent and separated lower portion engagement members extending away from said intermediate member lower surface.

11. The article of clothing wear indicator according to claim 10, wherein, said first upper portion engagement member and said second upper portion engagement member are arranged in a parallel manner relative to each other and within a first plane, and said third upper portion engagement member and said fourth upper portion engagement member are arranged in a parallel manner relative to each other and within a second plane, said first plane being different from that of said second plane; and said first lower portion engagement member and said second lower portion engagement member are arranged in a parallel manner relative to each other and within a first plane, and said third lower portion engagement member and said fourth lower portion engagement member are arranged in a parallel manner relative to each other and within a second plane, said first plane being different from that of said second plane.

12. The article of clothing wear indicator according to claim 1, wherein said upper portion comprises an internal surface having a ratcheting member configured to interact with at least a portion of said upper portion engagement member assembly.

13. The article of clothing wear indicator according to claim 1, wherein said lower portion comprises an internal surface having a ratcheting member configured to interact with at least a portion of said lower portion engagement member assembly.

14. The article of clothing wear indicator according to claim 1, wherein said first article of clothing wear indicator or said second article of clothing wear indicator includes indicia to indicate a number of times an article of clothing has been worn or to indicate a type of article of clothing.

15. The article of clothing wear indicator according to claim 14, wherein said indicia includes numbers, letters, symbols, pictures, or combinations thereof.

16. The article of clothing wear indicator according to claim 1, wherein said intermediate body includes a dual article of clothing wear indicator.

17. The article of clothing wear indicator according to claim 16, wherein said intermediate body includes, a first dual article of clothing wear indicator; and a second dual article of clothing wear indicator.

18. The article of clothing wear indicator according to claim 17, wherein said first dual article of clothing wear indicator is positioned on said intermediate body one-hundred eighty degrees from said second dual article of clothing wear indicator.

* * * * *